US006378975B1

(12) United States Patent
Elgee et al.

(10) Patent No.: US 6,378,975 B1
(45) Date of Patent: Apr. 30, 2002

(54) DROP DETECTION USING A MOVABLE STRIP

(75) Inventors: Steven B. Elgee, Portland, OR (US); Jefferson P. Ward, Brush Prairie, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/302,610

(22) Filed: Apr. 30, 1999

(51) Int. Cl.[7] ..... B41J 29/393
(52) U.S. Cl. ..... 347/19
(58) Field of Search ..... 347/19, 23, 33, 347/214; 400/615.2, 711, 716, 249, 207, 208

(56) References Cited

U.S. PATENT DOCUMENTS 4,907,013 A * 3/1990 Hubbard et al. ..... 347/19
5,353,052 A 10/1994 Suzuki et al. ..... 347/19
5,431,504 A * 7/1995 Beadman et al. ..... 400/692
5,798,773 A * 8/1998 Hiramatsu et al. ..... 347/19

FOREIGN PATENT DOCUMENTS

JP 2-146186 6/1990
JP 405177893 A * 7/1993 ..... 400/208

* cited by examiner

*Primary Examiner*—John Barlow
*Assistant Examiner*—An H. Do

(57) ABSTRACT

An ink jet printing system that includes a print media strip dispenser that advances a strip of test print media through a test print zone and then through a detect zone. Test dots are printed on a test portion of the strip of print media that is in the test print zone, and such test portion is then advanced to the detect zone for detection by an optical detector. Pursuant to such test print media strip advance, another test portion of the media strip is advanced into the test print zone and ready for printing of further test dots. By way of specific implementation, the print media strip dispenser comprises a cassette that includes a supply reel on which an elongated strip of unprinted test print media has been wound and a take-up reel for taking up and winding the elongated strip of print media as it is advanced.

10 Claims, 4 Drawing Sheets

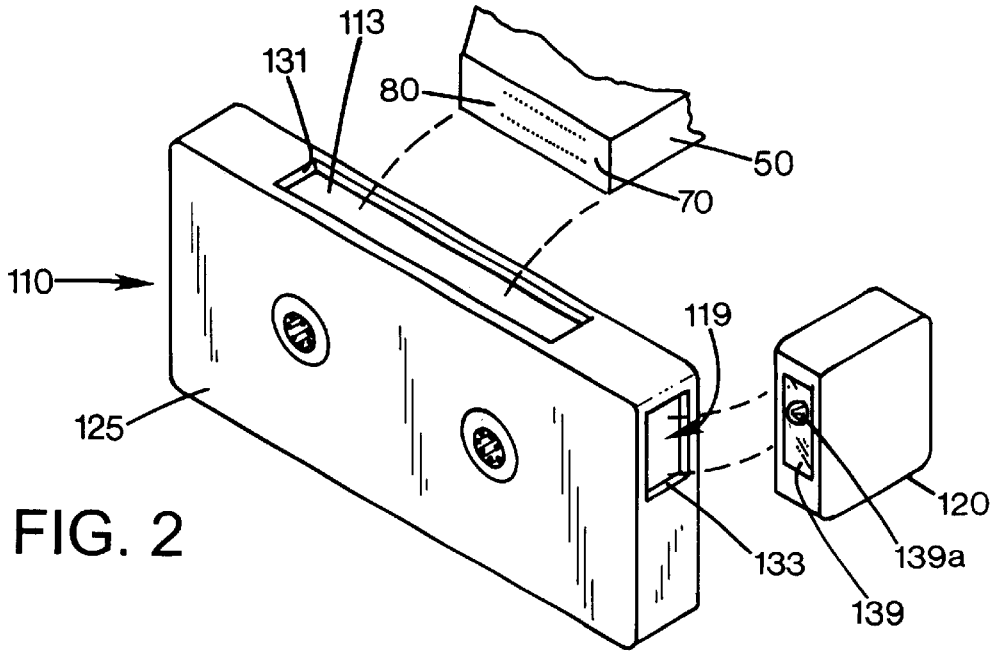
FIG. 2
FIG. 3
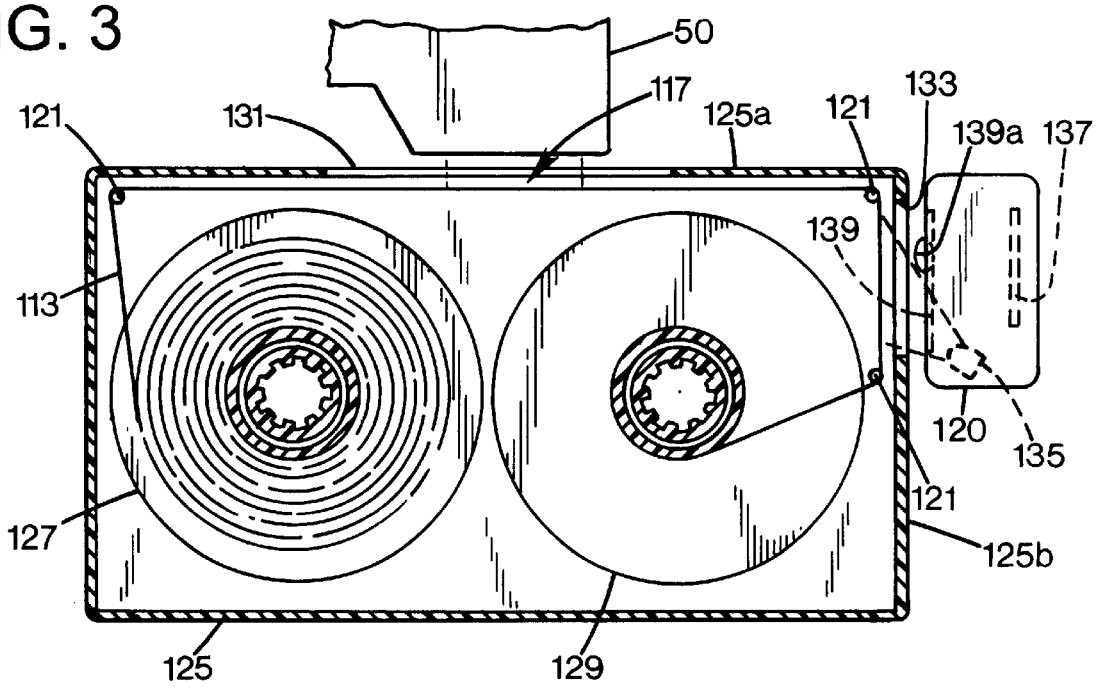

DROP DETECTION USING A MOVABLE STRIP

BACKGROUND OF THE INVENTION

The subject invention relates to ink jet printing, and more particularly to an ink jet dot detection system having a movable strip of print media on which test dots are printed.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels" . Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

An ink jet printhead includes an array of nozzles through which droplets of ink are fired, and the quality of the printed images produced by an ink jet printer depends to a large extent on whether nozzles are operative and the directionality of the ink drops emitted by the nozzles. Inoperative nozzles are sometimes called missing nozzles while drops that are not properly directed are sometimes called mis-directed drops. A nozzle that emits mis-directed drops can also be called a mis-directed nozzle.

Some ink jet printing devices include mechanisms for detecting missing and/or misdirected nozzles, so that such nozzles can be compensated to varying degrees by using an appropriate print mode or so that the user can be notified that too many nozzles are missing and/or misdirected. Print mode refers to the manner by which dots are placed on the print media. Techniques for detecting missing and/or misdirected nozzles include for example optical drop detectors comprised of a light source and a light sensor, and a patterned aperture. The operability and/or directionality of individual nozzles is/are detected by controlled energizing of the nozzles and detection of the presence or absence of ink drops in the light path between the light source and the light sensor. A consideration with optical drop detection is contamination of electro-optical elements by ink aerosol.

Another technique for detecting missing ad/or misdirected nozzles involves printing on a sheet of print media test patterns that are optically detected. Considerations with printing test patterns include the inconvenience to the user who will need to insert appropriate media (to avoid using expensive media such as photo media for testing) and later discard the print tested media.

There is accordingly a need for an efficient technique for detecting missing and/or mis-directed ink jet nozzles in an inkjet printing device.

SUMMARY OF THE INVENTION

The disclosed invention provides for an ink jet printing system that includes a print media strip dispenser that advances a strip of test print media through a test print zone and then through a detect zone. Test dots are printed on a test portion of the print media strip that is in the test print zone, and such test portion is then advanced to the detect zone for detection by an optical detector. Pursuant to such print media strip advance, another test portion of the print media strip is advanced into the test print zone and ready for printing of further test dots. By way of specific implementation, the print media strip dispenser comprises a cassette that includes a supply reel on which a strip of unprinted print media has been wound and a take-up reel for receiving the strip of test printed media after printing and detection of test dots.

BRIEF DESCRIPTION OF THE DRAWINGS

The advantages and features of the disclosed invention will readily be appreciated by persons skilled in the art from the following detailed description when read in conjunction with the drawing wherein:

FIG. 2 is an isometric view of the nozzle operation detection system of the invention.

FIG. 3 is an elevational view of the nozzle operation detection system of the invention.

DETAILED DESCRIPTION OF THE DISCLOSURE

Figure 1:
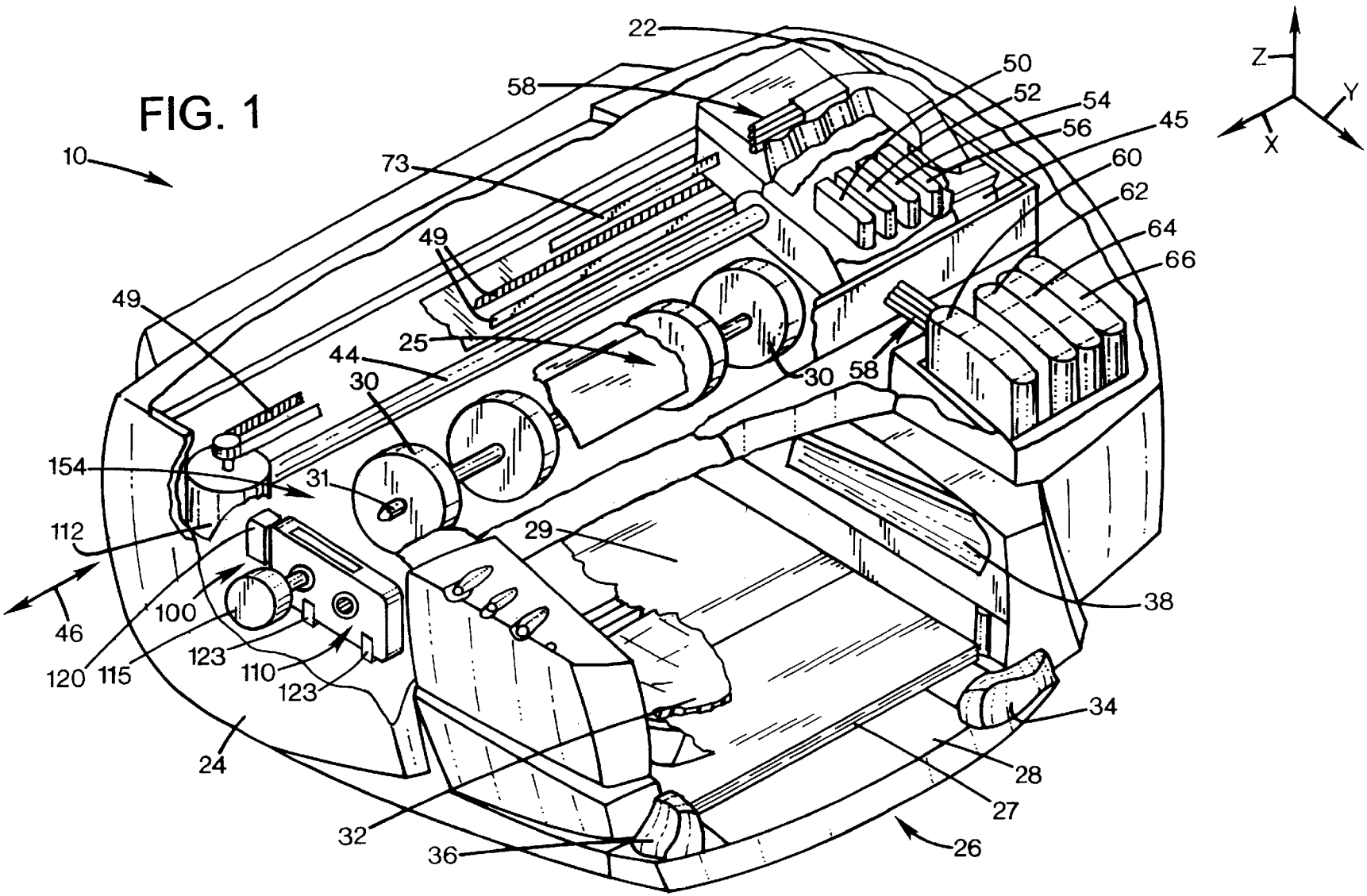
FIG. 1 is a perspective view of an ink jet print printing device incorporating a nozzle operation detection system in accordance with the invention.

In the following detailed description and in the several figures of the drawing, like elements are identified with like reference numerals.

FIG. 1 sets forth a schematic perspective view of an example of an ink jet printing device 10 in which the disclosed invention can be employed. The inkjet printing device includes inkjet printheads having a plurality of ink jet nozzles for applying marks on print media, and in accordance with the invention includes a nozzle operation detection system for detecting inoperative and/or misdirected nozzles. The nozzle operation detection system generally includes a print media strip dispenser that advances a strip of print media through a test print zone and then through a dot detect zone. A test pattern of dots is printed on a test portion of the print media strip that is in the test print zone, and such test portion is then advanced to the detect zone for detection by an optical sensor.

The ink jet printing device 10 of FIG. 1 more particularly includes a frame or chassis 22 surrounded by a housing, casing or enclosure 24, commonly made of a plastic material. Individual sheets of print media "picked" from a stack 27 of sheets of print media are individually fed through a print zone 25 by a media handling system 26. The print media may be any type of suitable sheet material such as paper, card-stock, transparencies, coated paper, fabric, and the like.

The media handling system includes an input media supply feed tray 28 for storing the stack 27 of sheets of print media before printing. A print media drive roller assembly 154 formed of a plurality of laterally spaced drive wheels or tires 30 co-axially mounted on a common axle 31 and conventionally driven by a stepper motor and drive gear assembly (not shown) may be used to move the print media from the feed tray 28, through the print zone 25, and, after printing, onto a pair of extended output drying wing members 38, shown in a retracted or rest position in FIG. 1. The wing members 38 hold the newly printed sheet for a short time above any previously printed sheets still drying in an output tray 32, and then retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34 and a sliding width adjustment lever 36.

A carriage slider or guide rod 44 is supported by the chassis 22 to slidably support an off-axis ink jet print carriage system 45 for back and forth, or reciprocating, motion across the print zone 25 along a carriage axis 46 which is substantially parallel to the X-axis of an XYZ coordinate system shown in FIG. 1. A carriage scan axis drive motor 112 drives an endless belt 49 that is secured in a conventional manner to the print carriage 45, and a linear encoder strip 73 is utilized to detect position of the print carriage system 45 along the carriage scan axis, for example in accordance with conventional techniques.

In the print zone 25, a media sheet receives ink from an ink jet cartridge, such as a black ink cartridge 50 and three single color ink cartridges 52, 54 and 56 which include respective printheads, such as representative printhead 70 of the ink cartridge 50 shown in FIG. 2, that selectively eject ink drops to form an image on the media sheet in the print zone 25. By way of illustrative example, the print zone 25 is below the cartridges 50, 52, 54 and 56, and the printheads eject ink drops downwardly. Ink jet cartridges 50, 52, 54, and 56 are also commonly called "pens" by those in the art. In accordance with what is known as an "off-axis" ink delivery system, each of the pens 50, 52, 54 and 56 includes a small on-board reservoir for storing ink that is received from a replaceable main ink reservoir located separately from the pen. In the illustrated printer 10, ink of each color for each printhead is delivered via a conduit or tubing system 58 from a group of replaceable stationary ink reservoirs 60, 62, 64 and 66 to the on-board reservoirs of respective pens 50, 52, 54 and 56.

While the printhead cartridges 50, 52, 54, and 56 are disclosed as printhead cartridges that receive ink from respective remote ink reservoirs 60, 62, 64 and 66, it should be appreciated that the printhead cartridges can comprise self-contained printhead cartridges that have on-board ink reservoirs that are not coupled to remote ink reservoirs. Additionally, the printhead for each color may be separate, as shown, or integrated with two or more colors per printhead. And while four colors are shown, the printing system may employ any number of colors or shades.

As schematically illustrated in FIG. 2 by a nozzle array 80 of the printhead 70 of the printhead cartridge 50 in FIG. 3, each of the printheads of the pens 50, 52, 54 and 56 includes an orifice or nozzle plate having an array of ink ejecting nozzles formed therein in a manner well know to those skilled in the art. By way of illustrative example, the printheads of the pens 50, 52, 54 and 56 comprise thermal ink jet printheads. Other types of printheads may also be used, such as piezoelectric printheads.

By way of example, the nozzles of each of the printheads of the pens 50, 52, 54 and 56 are arranged as a columnar array of nozzles aligned with the media axis or media advance axis that is parallel to the Y axis XYZ coordinate system of FIG. 1. By of specific example, as schematically illustrated in FIG. 2, each nozzle array of the cartridges 50, 52, 54, 56 includes nozzles arranged in two columns which are parallel to the media advance axis, wherein the nozzle columns are staggered relative to each other.

The distance along the media scan axis between diagonally adjacent nozzles of each nozzle array is known as the nozzle pitch. In use, the physical spacing between the columns of nozzles in a printhead is compensated by appropriate data shifts in the swath print data so that the two columns function as a single column of nozzles.

The printing device of FIG. 1 includes a nozzle operation detection system 100 that detects whether nozzles of the printheads of the printhead cartridges 50, 52, 54, 56 are operational and/or properly directed or aimed.

As more particularly shown in FIGS. 2 and 3, the nozzle operation detection system 100 includes a print media strip dispenser 110 that stores an elongated print media strip or tape 113 and advances the print media strip pursuant to actuation by a motor 115 (FIG. 1). The print media strip is more particularly advanced through a test print zone 117 that is beneath the printheads of the print cartridges 50, 52, 54, 56, and through a dot detect zone 119 that is adjacent an optical sensor 120 and spaced apart from the test print zone. The optical sensor 120 detects the presence or absence of dots on the print media that is in the detect zone 119.

By way of illustrative example, the tape dispenser 110 is a cassette that is retained in the printer by brackets 123. The cassette can be permanent or replaceable, and comprises a housing 125, a supply reel 127 on which the elongated print media strip 113 is wound and stored, and a take-up reel 129 for advancing and winding the elongated media strip 113 pursuant to actuation by the motor 115, so that the portion of the print media strip 113 that has been advanced through the test print zone 117 and the dot detect zone 119 is wound and stored on the take-up reel 129. Guides 121 guide the travel of the print media strip and define a print media strip travel path that passes adjacent a top edge 125*a* of the housing 125 and adjacent a side edge 125*b* of the housing 125.

The housing 125 includes a first window opening 131 formed in the top edge 125*a* of the housing 125 adjacent the travel path of the print media strip 113 and located such that a portion of the print media strip 113 that is adjacent the window opening 131 is in the test print zone 117 when the cassette is installed in the printer, which allows dots to be printed on the portion of the print media strip 113 that is in the test print zone. The housing 125 also includes a second window opening 133 formed in the side edge 125*b* of the housing adjacent the travel path of the print media strip and located such that a portion of the print media strip 113 that is adjacent the window opening 133 is in the dot detect zone 119 when the cassette is installed in the printer, which allows for detection of dots on the portion of the print media strip 113 that is the dot detect zone 119.

Also by way of illustrative example, the optical sensor 121 includes a light source 135 for illuminating the dot detect zone 119 through a window 139, an image sensor array 137, and an imaging lens 139*a* formed in the window 139 for imaging a portion of the print media strip that is in the dot detect zone 119 onto the image sensor array 137 which can comprise a linear array or a two-dimensional array, for example.

By way of specific example, the test print zone 117 is laterally displaced along the carriage axis from the print zone through which print media would normally be advanced.

Figure 4:
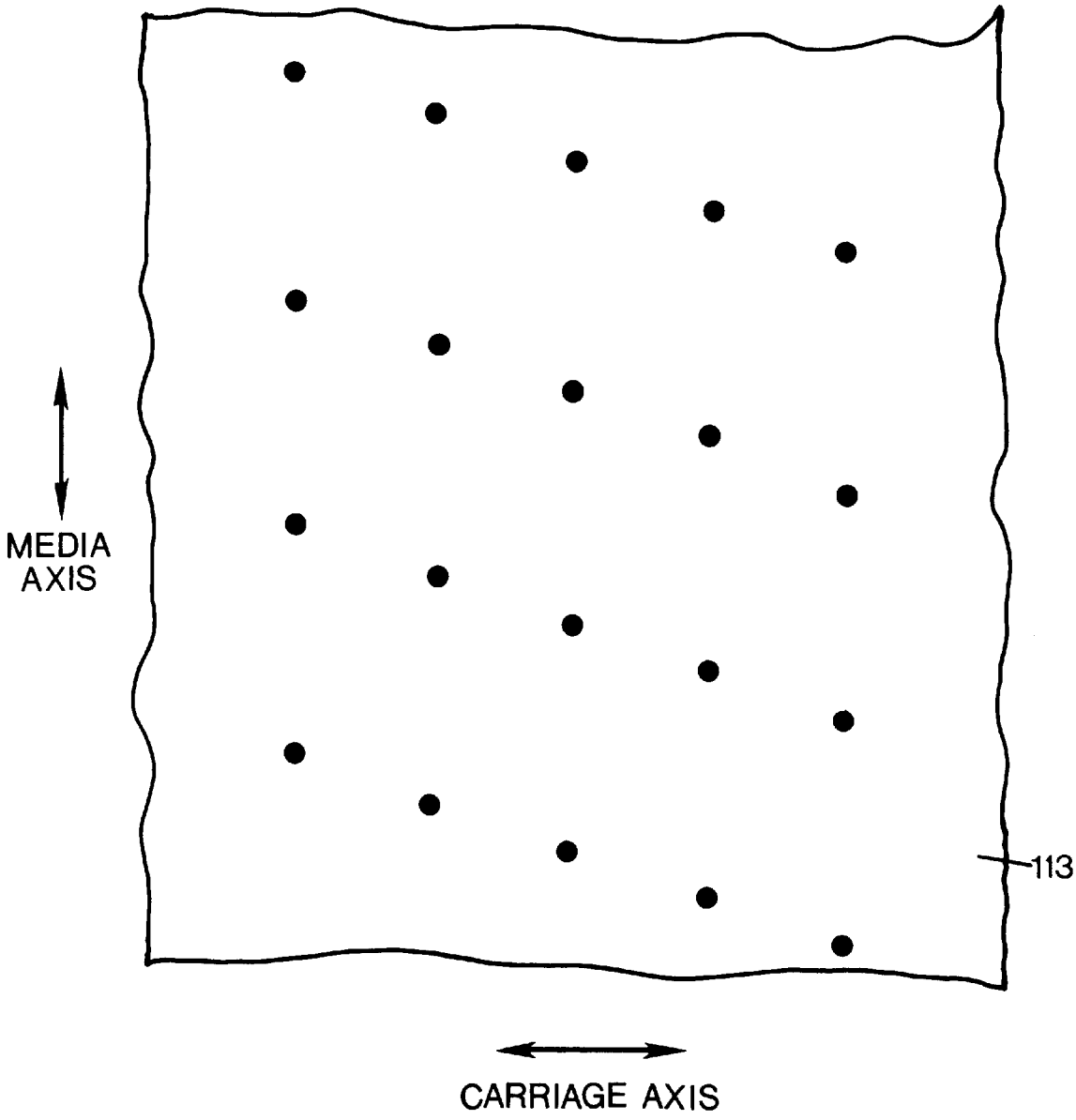
FIG. 4 is a schematic illustration of an example of a test pattern that would be printed by a printhead of the ink jet printing device of FIG. 1 on a print media strip of the nozzle operation detection system.

In use, the print media strip 113 is advanced to position an unprinted portion of the print media strip 113 in the test print zone 117, and a test pattern of dots is printed on such portion of the print media strip 113 by one or more print cartridges. The dots are printed in a sparse pattern that is distributed over a plurality of columns, so that the printed dots are sufficiently separated from each other to be individually detectable by the optical sensor 121. For example, the nozzles of each printhead are grouped into groups of N nozzles that are contiguous along the media axis print, and the nozzles for each group respectively print dots at column locations that are separated by 2 or 3 columns. The resulting test pattern for a given printhead would be a plurality of diagonal dotted line segments as schematically shown in FIG. 4 for the example of N=5. For a printhead having operational and properly directed nozzles, the spacing between dots along the media axis is equal to the nozzle spacing along the media axis while the spacing between dots along the carriage scan axis is greater than the normal carriage axis dot spacing. Effectively, for the test pattern of FIG. 4, the nozzles of a printhead are controlled to print short diagonal line segments wherein the spacing along the carriage axis is sufficiently large to ensure that the individual dots are separated from one another.

The print media strip 113 is then advanced to advance the test printed portion of the print media strip 113 through the dot detect zone 119 where the printed dots are detected by the optical sensor 121. For example, the test printed portion is imaged while it is moving through the dot detect zone to produce a series of images that are compared with reference images.

If less than all printheads were earlier tested, the foregoing procedure of printing a test pattern of dots on an unprinted portion of the print media strip, advancing the print media strip, and detecting the printed test pattern is performed as necessary to test all of the printheads.

Figure 5:
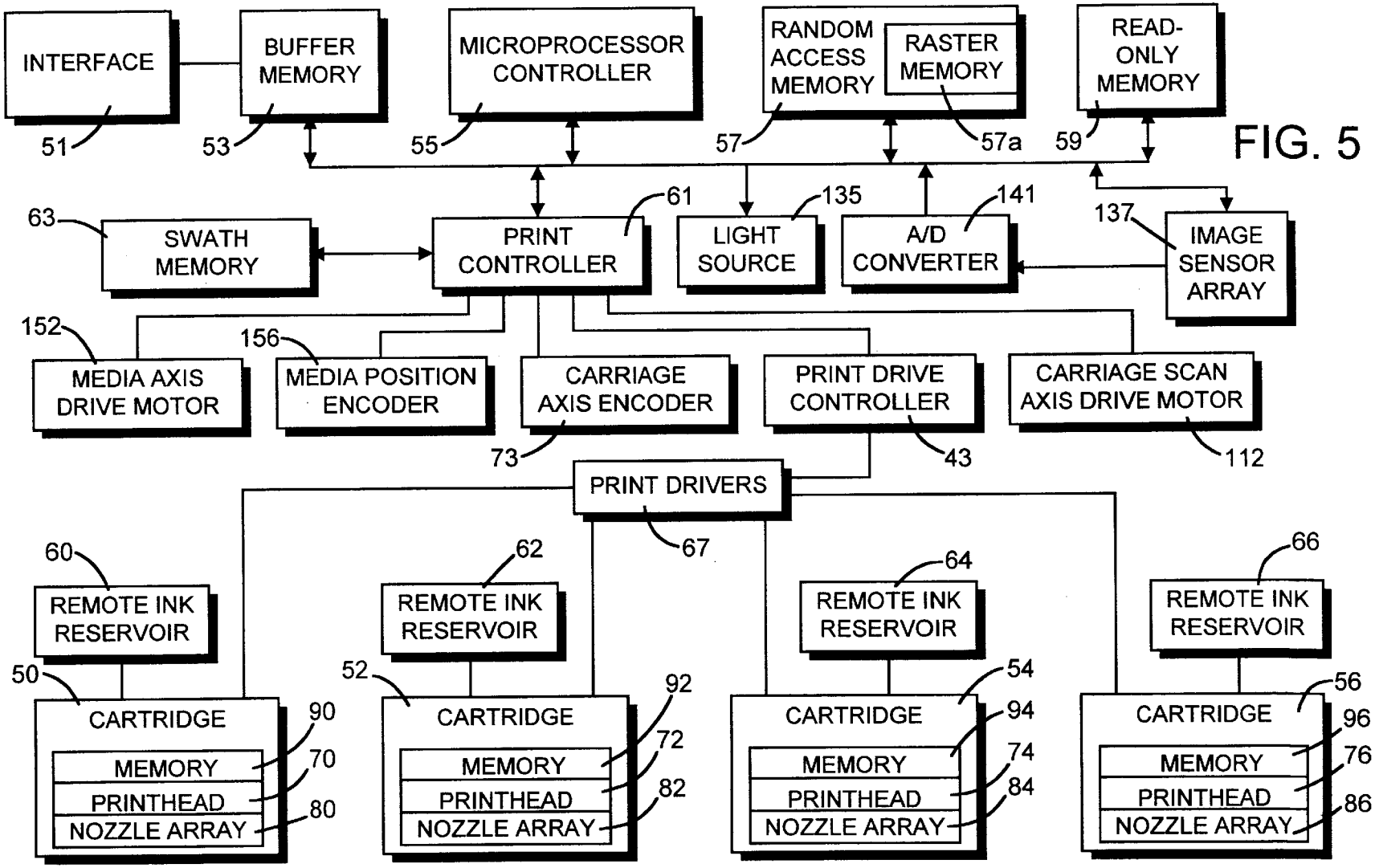
FIG. 5 is a simplified block diagram of a printer controller for controlling the ink jet printing device of FIG. 1.

Referring now to FIG. 5, set forth therein is a simplified block diagram of a control system for controlling the ink jet printer of FIG. 1 in which the techniques of the invention can be implemented. The control system includes an interface 51 which receives print data from a host computer, for example, and stores the print data in a buffer memory 53. A microprocessor controller 55 is configured to process the print data to produce raster data that is stored in a bit-map raster memory 57*a* contained in a random access memory (RAM) 57 provided for the use of the microprocessor controller 55. A read-only memory 59 is also provided as appropriate for the use of the microprocessor controller 55.

The microprocessor controller also controls the light source 135 and the image sensor array 137 of the nozzle operation detection system 100 (FIG. 1), and receives the output an analog-to-digital converter 143 that provides a digital version of the analog output of the image sensor array 137. In response to the output of the image sensor array 137, the printer identifies nozzles that are missing and/or misdirected.

A print controller 61 transfers portions of the raster data from the bit-map raster memory 57*a* to a swath memory 63 and provides swath data to a printhead driver controller 43 which controls printhead drivers 67 that drive the ink firing elements of printhead cartridges 50, 52, 54 and 56 that are implemented as single color printhead cartridges and/or as multi-compartment cartridges. The printhead cartridges 50, 52, 54 and 56 include respective printheads 70, 72, 74 and 76 which in turn include respective nozzle arrays 80, 82, 84 and 86 that emit a single color or multiple colors, wherein for example a nozzle array the emits multiple colors is arranged in subarrays that emit ink drops of respective colors.

The printhead cartridges 50, 52, 54 and 56 also include memory elements 90, 92, 94 and 96, for example resistor patterns, each of which contains information about the cartridge such as type, as well as a unique identifier. When a cartridge is installed, the control system reads the information stored in the associated memory element, for example to ensure that the cartridge is of the appropriate type for the particular printer. The control system can also determine whether the newly installed cartridge is a cartridge that had been removed subsequent to an earlier installation.

The print controller 61 further controls a media axis drive motor 152 which moves the print drive roller assembly 154 (FIG. 1) pursuant to media motion commands from the print controller 61. The media position encoder 156 provides information for the feedback control of the media axis drive motor 152. Similarly, the carriage axis encoder 73 provides feedback information for the feedback control of the carriage scan axis drive motor 112 which positions the print carriage 45 (FIG. 1) pursuant to carriage motion commands from the print controller 61.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet printer comprising:

an ink jet print cartridge including an ink jet printhead;

a scanning mechanism for reciprocatingly moving said ink jet print cartridge along a scan axis across a print zone where normal printing is performed;

an elongated strip of print media;

a print media strip cassette displaced from said print zone for advancing said elongated strip of print media through a test print zone and a dot detect zone that are in different non-parallel planes, said test print zone being displaced from said print zone and located so that said ink jet printhead can apply marks to a test portion of said elongated strip of print media disposed in said test print zone; and a detector for detecting marks applied to said test portion of said elongated strip of print media.

2. The printing system of claim 1 wherein said detector comprises an optical detector.

3. The ink jet printer of claim 1 wherein said print media strip cassette comprises a housing having a test print window adjacent said test print zone, and a dot detect window adjacent said dot detect zone, said test print window and said dot detect window being in different non-parallel planes.

4. The ink jet printer of claim 3 wherein said housing includes a top edge and a side edge that are not co-linear, and wherein said test print window is located in said top edge and said dot detect window is located in said side edge.

5. The ink jet printer of claim 1 wherein said print media strip cassette is replaceable.

6. The ink jet printer of claim 1 further including a controller for controlling said printhead and said scanning mechanism to print a sparse test pattern on said elongated strip of print media in said test print zone, said sparse test pattern including dots separated along a carriage scan axis by a plurality of dot columns so as to be individually detectable.

7. A print media strip cassette, comprising:

a housing;

an elongated strip of print media;

a supply reel on which said elongated strip of print media is wound;

a take-up reel for taking-up said elongated strip of print media;

guides for guiding said elongated strip of print media along a media strip travel path;

a print window disposed in said housing adjacent said media strip travel path; and a dot detect window disposed in said housing adjacent said media strip travel path, said print window and said dot detect window being in different non-parallel planes.

8. The print media strip cassette of claim 7 wherein said housing includes a top edge and a side edge that are not co-linear, and wherein said test print window is located in said top edge and said dot detect window is located in said side edge.

9. A method of operating a printing device having marking apparatus for making marks on a print medium, the method comprising the steps of:

positioning a test portion of a strip of print media which is contained in a removable cassette in a test print zone that is displaced from a print zone where normal printing is performed;

printing a pattern of test dots on the test portion;

moving the strip of print media to position the test portion to a dot detect zone that is viewable from outside the removable cassette and in a different and non-parallel plane from the test print zone; and detecting the pattern of test dots on the test portion.

10. The method of claim 9 wherein printing a pattern of test dots includes printing a sparse test pattern of dots that are separated so as to be individually detectable.

* * * * *